US005816227A

United States Patent [19]

Cronk

[11] Patent Number: 5,816,227

[45] Date of Patent: Oct. 6, 1998

[54] MAGNETIC FUEL STABILIZER

[76] Inventor: John E. Cronk, 2594 Spruce Creek Blvd., Daytona Beach, Fla. 32124

[21] Appl. No.: 916,883

[22] Filed: Aug. 22, 1997

Related U.S. Application Data

[60] Provisional application No. 60/023,435 Aug. 22, 1996.

[51] Int. Cl.[6] ..... F02M 27/00

[52] U.S. Cl. ..... 123/538

[58] Field of Search ..... 123/536, 537, 123/538; 210/695, 222

[56] References Cited

U.S. PATENT DOCUMENTS

| | | | |
|---|---|---|---|
| 2,612,268 | 9/1952 | Merwin . | |
| 2,613,246 | 10/1952 | Spodig . | |
| 3,170,871 | 2/1965 | Moriya . | |
| 4,188,296 | 2/1980 | Fujita . | |
| 4,372,852 | 2/1983 | Kovacs . | |
| 4,572,145 | 2/1986 | Mitchell et al. | 123/538 |
| 4,711,271 | 12/1987 | Weisenbarger et al. | 123/538 |
| 4,808,306 | 2/1989 | Mitchell et al. | 123/538 |
| 4,995,425 | 2/1991 | Weisenbarger et al. . | |
| 5,048,498 | 9/1991 | Cardan | 123/538 |
| 5,124,045 | 6/1992 | Janczak et al. . | |
| 5,329,911 | 7/1994 | Jeong . | |

OTHER PUBLICATIONS

FuelMaster magnetic fuel saver advertizements and installation instructions (3 pp.)–not dated. Sage International Inc., Philadelphia, PA U.S.A.

*Primary Examiner*—Marguerite McMahon
*Attorney, Agent, or Firm*—Paul S. Rooy

[57] ABSTRACT

A magnetic fuel stabilizer comprising a fuel line between a metal plate and a magnet. The metal plate is electrically connected to ground by means of a shunt. The magnet comprises a magnet fuel line side in contact with the fuel line at a fuel line magnet side. The metal plate is in contact with the fuel line at a fuel line metal plate side. The magnet further comprises a magnet non-fuel line side opposite the magnet fuel line side, and a magnet right side opposite a magnet left side. The magnet right and left sides are substantially perpendicular to the fuel line.

7 Claims, 2 Drawing Sheets

MAGNETIC FUEL STABILIZER

BACKGROUND OF THE INVENTION

This application claims benefit usc Provisional Appln. No. 60/023,435 filed Aug. 22, 1996.

FIELD OF THE INVENTION

This invention relates to fuel treatments, and in particular to a magnetic fuel stabilizer.

BACKGROUND OF THE INVENTION

The internal combustion engine has long been used to supply rotary motion for a myriad of applications. Only a few examples of these include modern automobiles, power boats, jet skis, powered airplanes, motorcycles, off-road vehicles, trucks, forklifts, etc.

There are several problems which recur in these applications. One problem is the incomplete combustion of the fossil fuels burned by these internal combustion engines. Another problem are the excess emissions which such incomplete combustion causes, giving rise to serious air pollution which may endanger our ecology on a global scale. Still another problem is caused by the carbon and varnish buildups which occur in the carburetor, fuel injectors, engine, and exhaust systems of internal combustion engines caused by incomplete combustion. Such buildups and combustion byproducts may cause acid build-up in exhaust systems, thereby reducing their life.

Yet another problem associated with incomplete combustion is reduced fuel efficiency and decreased vehicle performance. In an automobile, this translates to decreased miles per gallon achieved. Still another problem associated with modern internal combustion engines is the lack of a mechanism which may electrically charge air used in the combustion, thus also helping reduce excess non-combusted exhaust products, along with the many problems caused by these emissions.

SUMMARY OF THE INVENTION

Accordingly, it is an object of the present invention to provide a magnetic fuel stabilizer which makes fuel more potent. Design features allowing this object to be accomplished include a fuel line between a metal plate and a magnet. Advantages associated with the accomplishment of this object include increased power and enhanced fuel economy.

It is another object of the present invention to provide a magnetic fuel stabilizer which increases percentage of fuel burned. Design features allowing this object to be accomplished include a fuel line between a metal plate and a magnet. A benefit associated with the accomplishment of this object is decreased air pollution.

It is still another object of this invention to provide a magnetic fuel stabilizer which reduces carbon and varnish build-up in the carburetor, fuel injectors, engine and exhaust system. Design features enabling the accomplishment of this object include a fuel line between a metal plate and a magnet. An advantage associated with the realization of this object is the reduction of deterioration of the carburetor, fuel injectors, engine and exhaust system.

It is another object of the present invention to provide a magnetic fuel stabilizer which rearranges the molecular structure of fuel burned in an engine. Design features allowing this object to be accomplished include a fuel line between a metal plate and a magnet. A benefit associated with the accomplishment of this object is cleansing of fuel to be burned.

It is still another object of this invention to provide a magnetic fuel stabilizer which separates the fuel molecules. Design features enabling the accomplishment of this object include a fuel line between a metal plate and a magnet. Advantages associated with the realization of this object include more complete combustion and virtually no combustion residue.

It is another object of the present invention to provide a magnetic fuel stabilizer which charges incoming air used in combustion. Design features allowing this object to be accomplished include fuel within a fuel line, the fuel line being disposed between a metal plate and a magnet, and the fuel mixing with air, thereby charging the air prior to combustion. A benefit associated with the accomplishment of this object is reduction in the amount of condensation in an exhaust system.

It is still another object of this invention to provide a magnetic fuel stabilizer which provides protection from electrical sparks in the vicinity of fuel. Design features enabling the accomplishment of this object include a fuel line between a metal plate and a magnet, and a shunt wire connecting the metal plate to electrical ground. An advantage associated with the realization of this object is the reduction of danger of fire.

BRIEF DESCRIPTION OF THE DRAWINGS

The invention, together with the other objects, features, aspects and advantages thereof will be more clearly understood from the following in conjunction with the accompanying drawings.

Two sheets of drawings are provided. Sheet one contains FIGS. 1 and 2. Sheet two contains FIGS. 3 and 4.

DETAILED DESCRIPTION OF THE PREFERRED EMBODIMENT

Figure 1:
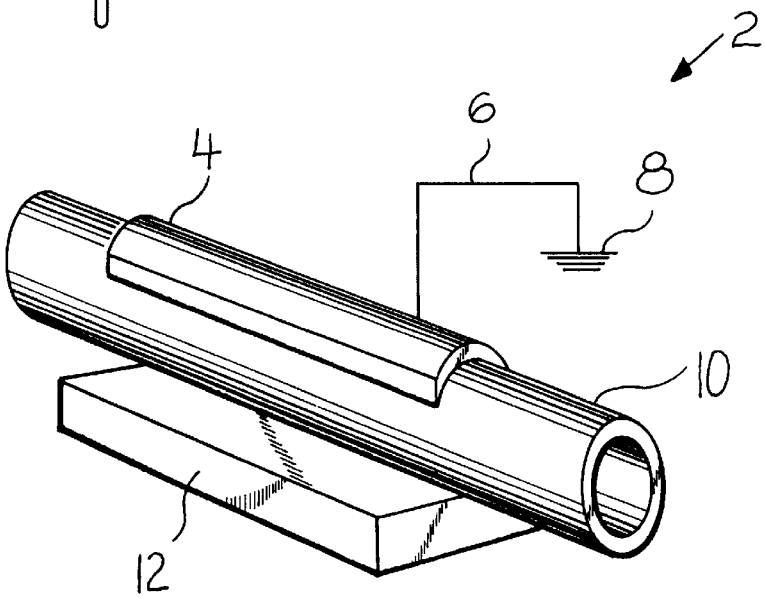
FIG. 1 is a front quarter isometric view of a magnetic fuel stabilizer.
Figure 2:
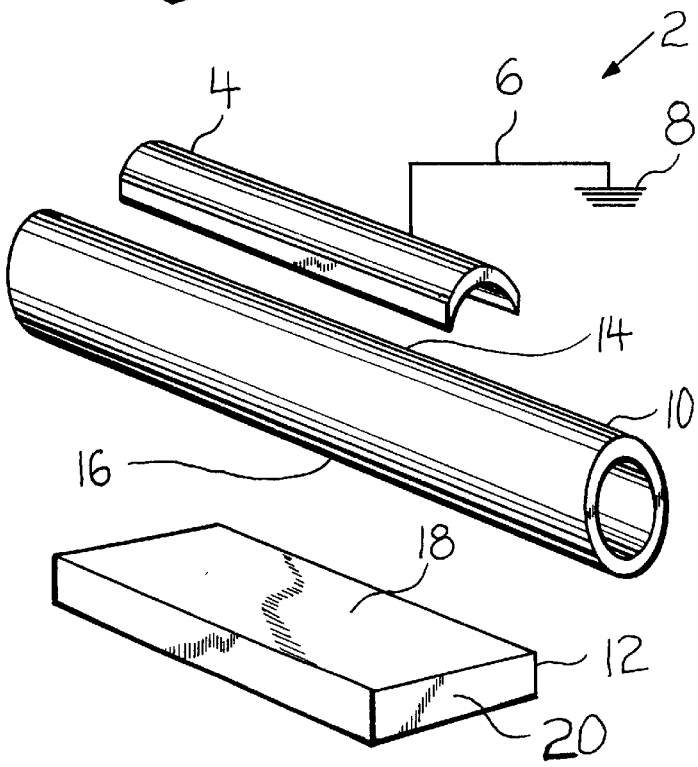
FIG. 2 is a front quarter exploded isometric view of a magnetic fuel stabilizer.

FIG. 1 is a front quarter isometric view of magnetic fuel stabilizer 2. FIG. 2 is a front quarter exploded isometric view of magnetic fuel stabilizer 2. Referring now to FIGS. 1 and 2, magnetic fuel stabilizer 2 comprises metal plate 4 in contact with fuel line 10 at fuel line metal plate side 14, and magnet 12 in contact with fuel line 10 at fuel line magnet side 16. Fuel line metal plate side 14 is disposed on a surface of fuel line 10 opposite fuel line magnet side 16. Shunt 6 electrically connects metal plate 4 with electrical ground 8.

Figure 3:
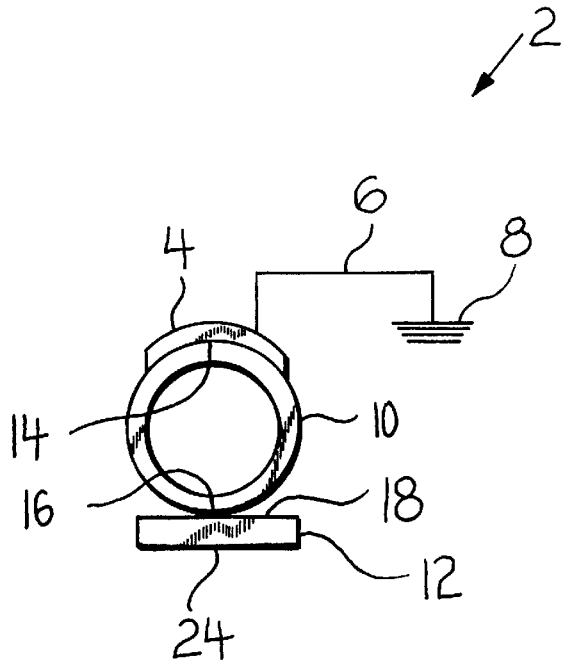
FIG. 3 is a front view of a magnetic fuel stabilizer.
Figure 4:
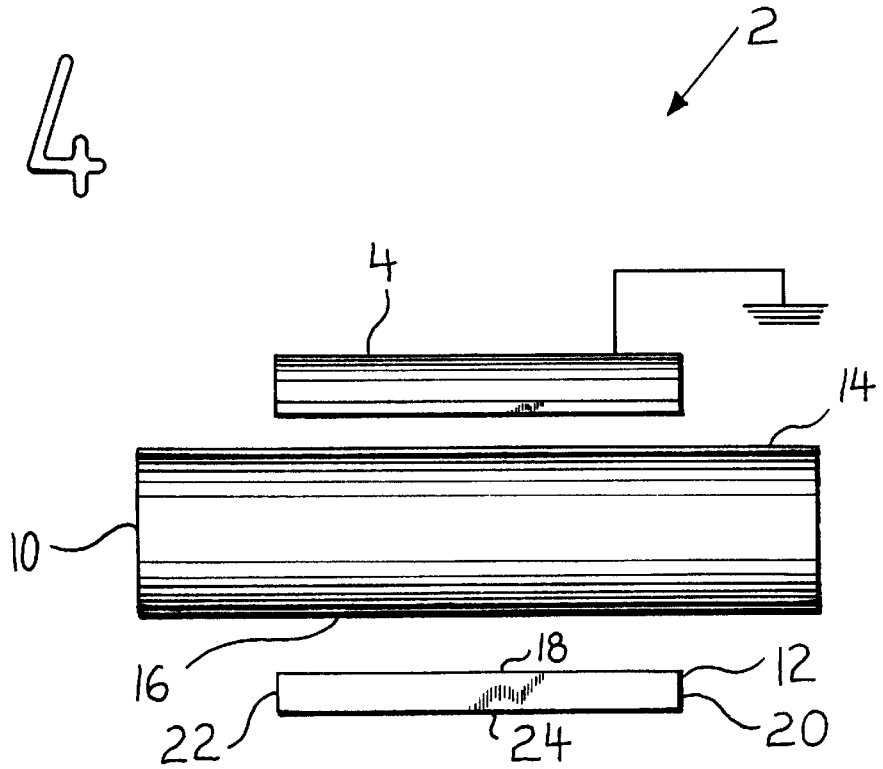
FIG. 4 is a side exploded isometric view of a magnetic fuel stabilizer.

FIG. 3 is a front view of magnetic fuel stabilizer 2. FIG. 4 is a side isometric view of magnetic fuel stabilizer 2. As may be observed in FIGS. 2–4, magnet 12 is a rectangular prism (a "shoe box" shape). Magnet 12 comprises magnet fuel line side 18, magnet non-fuel line side 24 disposed on a side of magnet 12 opposite magnet fuel line side 18, magnet right side 20, and magnet left side 22 disposed on a side of magnet 12 opposite magnet right side 20.

Magnet fuel line side 18 is disposed adjacent to fuel line magnet side 16, and is substantially planer. Magnet fuel line side 18 is substantially a tangent plane to fuel line 10, when magnetic fuel stabilizer is viewed axially as is illustrated in FIG. 3. Magnet right side 20 and magnet left side 22 are substantially perpendicular to fuel line 10, as may be observed in FIGS. 2 and 4.

An important difference between the prior art and the instant invention, is the polarity of magnet 12. Magnet left side 22, magnet right side 20 and magnet fuel line side 18 are north poles of magnet 12. Magnet non-fuel line side 24 is a south pole of magnet 12. Magnet fuel line side 18 is dispose in a position tangent to fuel line 10 when fuel line 10 is viewed axially. Magnet right side 20 and magnet left side 22 are disposed substantially perpendicular to a centerline of fuel line 10. It is this unique polarity of magnet 12, in combination with the geometric relationship between fuel line 10, magnet fuel line side 18, magnet non-fuel line side 24, magnet right side 20, and magnet left side 22, which cause the impressive benefits provided by the instant invention.

An important safety feature is provided by shunt 6. Shunt 6 electrically connects metal plate 4 to ground 8. Thus if a spark is present in the vicinity of magnetic fuel stabilizer 2, shunt 6 conducts the spark to ground 8, thereby preventing unintentional combustion of fuel within fuel line 10.

In the preferred embodiment, fuel line 10 was a standard automobile fuel line, or a fuel line supplying fuel to an internal combustion engine. Metal plate 4 was a metal plate manufactured of any ferromagnetic material. Shunt 6 was an electrical wire, typically in the 16–18 gage size. Magnet 12 was a permanent magnet having magnet right side 20, magnet left side 22 and magnet fuel line side 18 of north polarity, and magnet non-fuel line side 24 of south polarity.

While a preferred embodiment of the invention has been illustrated herein, it is to be understood that changes and variations may be made by those skilled in the art without departing from the spirit of the appending claims.

I claim:

1. A magnetic fuel stabilizer comprising a fuel line between a metal plate and a magnet, said magnet comprising a magnet fuel line side in contact with said fuel line at a fuel line magnet side, said magnet fuel line side being of north polarity, said magnet being a rectangular prism further comprising a magnet non-fuel line side disposed on a side of said magnet opposite said magnet fuel line side, a magnet right side, and a magnet left side disposed on a side of said magnet opposite said magnet right side, said magnet non-fuel line side being of south polarity, and said magnet left side and said magnet right side being of north polarity.

2. The magnetic fuel stabilizer of claim 1 wherein metal plate is made of ferromagnetic material.

3. A magnetic fuel stabilizer comprising a fuel line between a ferromagnetic metal plate and magnet, said magnet comprising a magnet fuel line side in contact with said fuel line at a fuel line magnet side, said magnet fuel line side being of north polarity, said magnet being a rectangular prism comprising a magnet non-fuel line side disposed on a side of said magnet opposite said magnet fuel line side, a magnet right side, and a magnet left side disposed on a side of said magnet opposite said magnet right side, said magnet non-fuel line side being of south polarity, and said magnet left side and said magnet right side being of north polarity, and a shunt electrically connecting said metal plate with electrical ground, whereby sparks in the vicinity of said magnetic fuel stabilizer may be conducted away from said magnetic fuel stabilizer to ground, thus avoiding unintentional fuel combustion.

4. A magnetic fuel stabilizer comprising a fuel line between a metal plate and a magnet, a shape of said magnet being a rectangular prism, said magnet comprising a magnet fuel line side in contact with said fuel line, said magnet fuel line side being substantially planer and disposed tangentially to said fuel line when said fuel line is viewed axially, said magnet fuel line side being of north polarity, said magnet comprising a magnet non-fuel line side disposed on a side of said magnet opposite said magnet fuel line side, a magnet right side, and a magnet left side disposed on a side of said magnet opposite said magnet right side, said magnet non-fuel line side being of south polarity, and said magnet right side and said magnet left side being of north polarity.

5. The magnetic fuel stabilizer of claim 4 wherein said magnet right side and said magnet left side are disposed substantially perpendicular to said fuel line.

6. A magnetic fuel stabilizer comprising a fuel line between a metal plate and a magnet, a shape of said magnet being a rectangular prism, said magnet comprising a magnet fuel line side in contact with said fuel line, said magnet fuel line side being substantially planer and disposed tangentially to said fuel line when said fuel line is viewed axially, said magnet fuel line side being of north polarity, said magnet comprising a magnet non-fuel line side disposed on a side of said magnet opposite said magnet fuel line side, a magnet right side, and a magnet left side disposed on a side of said magnet opposite said magnet right side, said magnet right side and said magnet left side being disposed substantially perpendicular to said fuel line, said magnet non-fuel line side being of south polarity, and said magnet right side and said magnet left side being of north polarity, and a shunt electrically connecting said metal plate to electrical ground, whereby sparks in the vicinity of said magnetic fuel stabilizer may be conducted away from said magnetic fuel stabilizer to ground, thus avoiding unintentional fuel combustion.

7. The magnetic fuel stabilizer of claim 6 wherein said metal plate is in contact with said fuel line at a fuel line metal plate side, and said magnet is in contact with said fuel line at a fuel line magnet side, said fuel line metal plate side being disposed on a surface of said fuel line opposite said fuel line magnet side.

* * * * *